US006974016B2

(12) United States Patent
Voser

(10) Patent No.: US 6,974,016 B2
(45) Date of Patent: Dec. 13, 2005

(54) CURRENCY ACCEPTORS

(75) Inventor: Christian Voser, Satigny (CH)

(73) Assignee: Mars Incorporated, McLean, VA (US)

( * ) Notice: Subject to any disclaimer, the term of this patent is extended or adjusted under 35 U.S.C. 154(b) by 261 days.

(21) Appl. No.: 10/645,750

(22) Filed: Aug. 20, 2003

(65) Prior Publication Data

US 2004/0050652 A1 Mar. 18, 2004

(30) Foreign Application Priority Data

Aug. 23, 2002 (EP) ..... 02255885

(51) Int. Cl.[7] ..... G07D 7/00

(52) U.S. Cl. ..... 194/302; 700/241; 700/244

(58) Field of Search ..... 194/302, 200; 73/156, 865.9; 340/870.03, 870.06, 870.11, 340/500, 501, 505, 679, 681, 3.1; 700/28, 700/51, 241, 244; 702/179, 182, 183, 188, 702/FOR 135; 705/1, 16, 400

(56) References Cited

U.S. PATENT DOCUMENTS

| | | | | |
|---|---|---|---|---|
| 4,631,357 | A * | 12/1986 | Grunig | 379/40 |
| 5,029,098 | A * | 7/1991 | Levasseur | 705/10 |
| 6,056,104 | A | 5/2000 | Neubarth et al. | |
| 6,230,150 | B1 * | 5/2001 | Walker et al. | 705/400 |

FOREIGN PATENT DOCUMENTS

| | | |
|---|---|---|
| EP | 0 294 068 A2 | 12/1988 |
| EP | 1 050 857 A2 | 11/2000 |
| WO | WO 99/49423 | 9/1999 |

* cited by examiner

*Primary Examiner*—Donald P. Walsh
*Assistant Examiner*—Mark J. Beauchaine
(74) *Attorney, Agent, or Firm*—Fish & Richardson P.C.

(57) ABSTRACT

A transaction system comprises multiple currency acceptors which can detect potential performance problems and send signals to a server. The server collects performance data and analyses it to determine the likelihood that common problems are caused by an external influence. The server can also analyze data from the acceptors to provide re-configuration data, for example modified measurement criteria used to classify currency articles.

26 Claims, 7 Drawing Sheets

CURRENCY ACCEPTORS

BACKGROUND

This invention relates to currency acceptors, and particularly to apparatus for receiving and validating banknotes and/or coins.

The performance of a currency acceptor or validator, or a transaction apparatus such as a vending machine which contains a currency validator, can vary as a result of many factors. It is generally not possible to predict accurately various aspects of performance, such as how many currency items (e.g. banknotes or coins) will be received by the validator, how many of them will be accepted and how many rejected, how often the apparatus will run out of change, etc. Accordingly, if the behaviour of the apparatus is not optimum, it is generally difficult to recognise this. If performance deteriorates it can be a considerable time before this is perceived, and then the cause of deterioration may not be apparent.

An example of this is that the apparatus may start to reject an increasing proportion of genuine banknotes of a particular denomination. Because many genuine banknotes of this denomination are accepted, it is not immediately obvious that a problem has arisen. It may be assumed that any rejections are due to the use of counterfeits or banknotes in poor condition. There may therefore be some considerable delay before the problem is recognised. Then, it may be assumed that the apparatus is faulty, in which case there will be a further delay before the apparatus is tested and, if necessary, repaired.

This circumstance can arise if banknotes of a particular denomination exist in different versions having slightly different characteristics, for example because they are made by different mints, or if the precise characteristics of the currency change due to a change in the manufacturing process. The characteristics of one version of the banknotes may be sufficiently different from the expected characteristics that the banknotes are more likely to be rejected. This may not happen frequently, if only a small proportion of banknotes are of this particular version. Accordingly, the problem may not be recognised quickly. When a genuine banknote is rejected, although the apparatus may not be at fault, it may be perceived as being faulty. Even after the problem has been noted, further difficulties would arise in collecting the rejected banknotes in sufficient quantities to analyse their characteristics so that the problem can be solved by reconfiguring the acceptor.

Corresponding problems of non-genuine currency being erroneously accepted may also occur if a new type of counterfeit is brought into use.

It would be desirable at least to mitigate these and other problems.

SUMMARY

Aspects of the present invention are set out in the accompanying claims.

According to an aspect of the invention, there is provided a system for indicating that a currency acceptor should be reconfigured, the system comprising means for transferring performance data from a plurality of operating currency acceptors to a means for analysing the data, the analysing means being operable to detect statistical anomalies indicative of impaired performance of one or more of the currency acceptors, and means for indicating the anomaly.

According to another aspect of the invention, there is provided a system for use in reconfiguring a currency acceptor, the system comprising means for transferring performance data from currency acceptors in use, means for analysing the data and means for calculating reconfiguration data for use by at least one of the acceptors to reconfigure the acceptor.

A preferred embodiment of the invention combines the above two aspects.

It is known to collect audit data from currency validators. This can be achieved by the validators, or their host machines (e.g. vending machines), being connected to a central server via a network. This may be a physical network, for example including telephone lines and/or the internet. Alternatively, it may be a non-physical network in which the audit data is downloaded from each machine into a module, the module then being physically transferred to the central server.

It is proposed that similar procedures could be used to collect from the machines performance data which can be analysed to detect the existence of anomalies indicative of non-optimum configuration and/or to generate reconfiguration data. Indeed, the same system could be used for transferring both performance data and audit data.

Using the techniques of the present invention, because data is collected from a plurality (and preferably many) currency acceptors, changes resulting from external circumstances affecting some or all of the validators can be detected readily from statistical analysis, and are distinguished from changes affecting an individual machine, for example as a result of a fault. This makes it possible to detect problems at an early stage, and perhaps even before they are recognised in the field, for example by detecting anomalies within the data from a group of currency acceptors as compared with the overall population being monitored, or by detecting changes within the population over time.

A further, independent advantage is that the currency acceptors in the field are used as a source of a large quantity of live data which can be statistically analysed to provide configuration data used in configuring or reconfiguring currency acceptors in order to improve performance. Normally, the configuration of a validator is carried out by statistical processing of data acquired by the manufacturer using equipment in the factory, and possibly augmented by algorithms responsive to the measurements of currency items received by the individual acceptor during use (see for example GB-A-2 059 129). Using the techniques of the present invention, however, a much larger quantity of statistical data is available, thus enabling better performance.

BRIEF DESCRIPTION OF THE DRAWINGS

Arrangements embodying the invention will now be described by way of example with reference to the accompanying drawings, in which.

DETAILED DESCRIPTION

Figure 1:
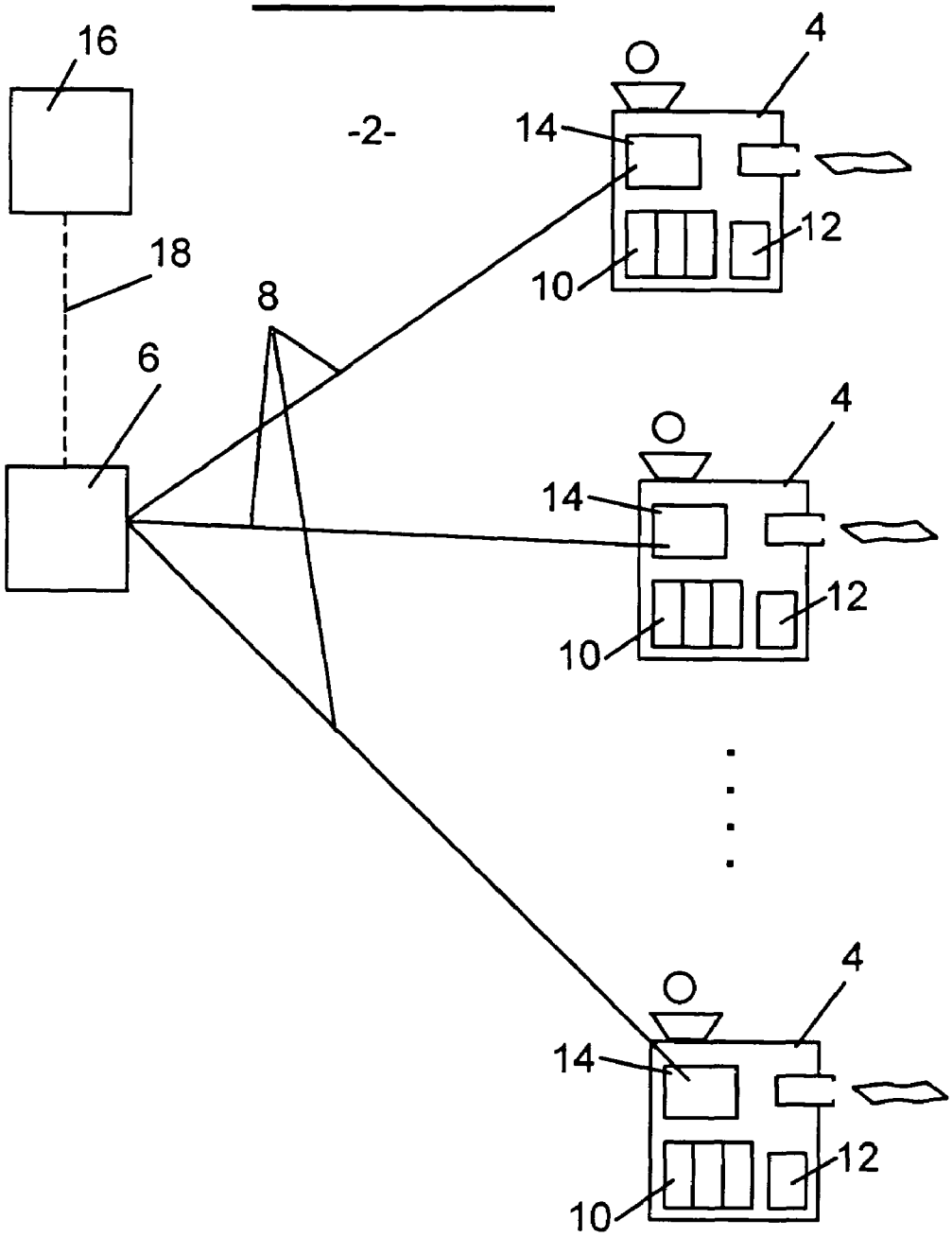
FIG. 1 schematically shows a multi-acceptor transaction system in accordance with the invention.

Referring to FIG. 1, a transaction system 2 comprises a plurality of currency acceptors 4 installed in respective host machines (not shown) such as vending machines or payphones. Each acceptor 4 can receive, measure and recognise currency articles in the form of coins and/or banknotes. Each currency acceptor 4 is operable to recognise articles belonging to any one of a set of known classes ("target classes") by applying stored measurement criteria to the measurements. For the purpose of the initial description it will be assumed that each currency acceptor takes a plurality of measurements of each currency article, and stores a set of ranges relating to each target class which it is capable of recognising. An article is deemed to belong to a target class if all its measurements fall within respective ranges associated with that class. The target classes are mostly associated with respective genuine article denominations, but one or more target classes may represent known types of counterfeits which will be rejected by the acceptors.

As will be described below, more sophisticated techniques could alternatively or additionally be used for article recognition.

Each of the currency acceptors 4 has a number of change stores 10 for storing currency articles of particular denominations for dispensing as change. These change stores are replenished by accepted currency articles of the appropriate denomination. Normally, the denominations stored in the change stores are only a sub-set of the denominations which the currency acceptor accepts. Each currency acceptor also has a cashbox 12 which receives those accepted currency articles which are not sent to the change stores, either because the denomination does not belong in the change stores or because the appropriate change store is full.

Periodically, each currency acceptor is attended by a serviceman who will empty the cashbox 12 and, optionally, alter the number of currency articles stored in the change stores to predetermined levels. This is referred to as a "float operation", and results in the levels of the different denominations being altered to correspond to predetermined respective "float levels".

In each of the currency acceptors 4, the change stores 10 can be re-configured so that they store a different combination of denominations.

In the present embodiment, each currency acceptor 4 is operable to record the following performance data:

(1) an identification number which is unique to the currency acceptor 4;

(2) the measurements of at least some of the articles tested by the currency acceptor 4;

(3) the quantity of each denomination stored for dispensing as change immediately prior to the float operation;

(4) the number of times each change store has become exhausted, resulting in a "change-starvation" problem.

Parameters (2) to (4) are held in a data store of each acceptor 4 and updated as appropriate by a control means 14 of the currency acceptor.

The transaction system also has a performance data server 6 which is operable to receive the performance data from each of the currency validators 4. The server 6 and the acceptors 4 are preferably connected together for transmission of data over transmission lines 8. Alternatively however, individual memory modules could be manually inserted into the currency acceptors 4 and then physically taken to the server 6 for transferring the data. The values constituting the performance data can be reset each time the data has been transferred to the server 6.

FIG. 1 also shows an acceptor identification store 16. This stores a list of the currency acceptors 4, using the identification numbers of the acceptors, and an indication of a geographical region within which each currency acceptor 4 is located.

FIGS. 2A to 2E show an example of an analysis operation which can be performed using the data transferred to the performance data server 6. This analysis can be performed by the server 6 itself (deriving data from the store 16 via a communication line 18), or by other means arranged to acquire data from the server 6 and store 16 either automatically or in response to a manual operation.

Figure 2A:
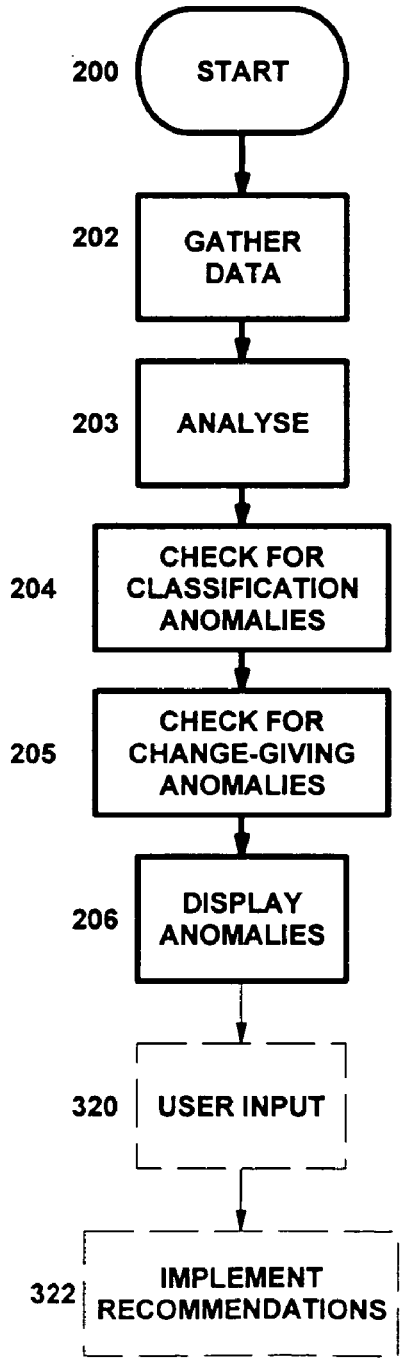
FIGS. 2A to 2E are flowcharts illustrating a monitoring procedure used in the transaction system of FIG. 1.

The procedure starts at step 200 (FIG. 2A).

At step 202, the performance data is collected from the currency acceptors 4. This can be achieved in a number of different ways. The server 6 could send instructions in sequence to each of the acceptors 4 to cause them to transmit their performance data. Alternatively, the servers 4 may each individually initiate the transfer of data at an appropriate time, for example when a float operation is performed. It is not necessary for all the performance data to represent concurrent states of the currency acceptors 4; the data could be gathered over a fairly lengthy period before it is analysed.

In a particularly preferred embodiment, a currency acceptor 4 communicates with the server 6 in response to detecting a performance problem. The communication may contain an indication of the nature of the performance problem, or may alternatively include also the performance data for the acceptor 4. The server 6 may be arranged, at step 202, to proceed only when the number of acceptors 4 reporting similar performance problems exceeds a threshold, or when the number of acceptors reporting problems within a specified period exceeds a threshold (either threshold preferably being dependent upon the total number of acceptors 4 in the system). In response to the threshold being reached, the server 6 may then request performance data from the acceptors 4 reporting similar problems (if it has not already received such performance data). The server may also be arranged to collect performance data from other acceptors 4 within the system, although this may not be necessary depending upon the specific implementation or the nature of the problems which have been reported.

In order to implement such an arrangement, each acceptor 4 preferably has means to detect any of a number of different potential performance problems. For example, each acceptor preferably has separate counters for recording change-starvation events in respect of different denominations, and is operable to initiate a communication with the server 6 when a count exceeds a predetermined threshold.

Similarly, each acceptor 4 is preferably operable to record rejections of currency articles, together with an indication of why the article was rejected, and to initiate a report to the server 6 if the number of articles rejected for the same reason exceeds a threshold. The acceptor 4 may be arranged to perform multiple tests, and to record which test resulted in rejection. In a particularly preferred embodiment, each acceptor initially performs a classification operation to determine the likely target class of each currency article, and then performs an authentication operation to determine whether the received article is genuine. Preferably, the acceptor 4 stores, for each rejected article, an indication of the initial classification. A potential problem may be detected if the ratio of rejected to accepted articles which have the same classification exceeds a threshold. Alternatively, the acceptor 4 may sub-classify the rejected articles according to the reason for rejection, and only report a problem if the ratio of articles rejected for the same reason exceeds a threshold. (EP-A-0 294 068 discloses an arrangement for monitoring the performance of an individual acceptor to determine problems associated with that acceptor, and similar techniques can be used in the present invention, which however additionally correlates information from multiple acceptors in order to detect external influences.)

At the end of step 202, the server 6 will therefore store performance data for, at least, those acceptors 4 which have reported performance problems. The performance data collected from each acceptor may include all the available data, or only the part of the data which is required to analyse the particular problem being reported. The data may be transferred from the acceptor 4 in a single operation, or may be transferred selectively and progressively in response to requests from the server which may be initiated in dependence on previously-received data from the respective acceptor and/or the particular operations being performed by the server.

At step 203, an initial data analysis is performed in order to establish statistical means and standard deviations of various parameters included in the performance data, such as the means and deviations for the measurements of classified articles, for the number of times each stored denomination is depleted so that adequate change is not available, the quantities of different denominations remaining in the stores when float operations are carried out, the number of times articles of the respective target classes have been received, the number of times articles have failed to be classified, etc. These statistical data are used for the subsequent detection of anomalies.

It is preferred to perform this statistical analysis using historical data gathered prior to the performance data gathered at step 202, instead of or in addition to this performance data (especially if the performance data relates only to a sub-set of the acceptors 4). The historical data can include previously-received performance data from all the acceptors, or in some cases data resulting from analysis performed by the acceptor manufacturer. The subsequent data analysis can thus detect anomalies resulting from changes in performance of acceptors, or from differences between some acceptors and others.

At step 204, the data is analysed to detect classification anomalies. This is followed at step 205 by an analysis to detect anomalies in the change-giving operation data. Example of possible analysis procedures 204 and 205 will be described below.

The program may be arranged to perform step 204 or step 205 only if it has received from the acceptors 4 indications that classification or change-giving problems, respectively, have occurred.

At step 206, an output is produced of the results of the analysis. This can be displayed on a screen or in the form of a printout. In this embodiment, the analysis will contain the following information:

(1) a list identifying those currency acceptors 4 which are suspected of being subject to fraud attempts using a new form of counterfeit article;

(2) a list identifying those currency acceptors 4 which are believed to have received but rejected genuine banknotes which differ in a common manner from a specific banknote class which the currency acceptors are designed to accept;

(3) a list identifying those currency acceptors 4 where it is determined that at least one of the float levels should be altered (and preferably an indication of the level to which it should be altered); and (4) a list identifying those currency validators 4 for which it is determined that the configuration of the change stores should be altered (preferably with an indication as to how the change stores should be re-configured).

The classification anomaly detection step 204 is based on the information stored by the acceptor identification store 16 and the performance data server 6. The procedure will be described below with reference to FIG. 2B.

This step is intended to detect problems arising as a result of currency acceptors receiving articles of a type which differs from those used to define the measurement criteria which are used in recognising the target classes.

Figure 3:
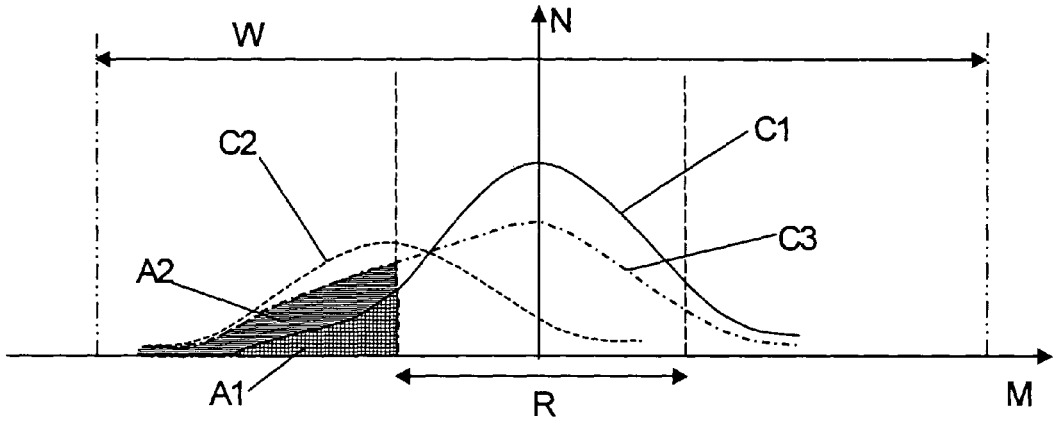
FIG. 3 is a diagram to assist in explaining in simplified form how a performance problem can be detected.

Referring to FIG. 3, this is a diagram indicating the distribution of measurements of one characteristic of articles belonging to a particular class CL, the horizontal axis representing the measurement value and the vertical axis the number of articles giving rise to the respective measurement values. The distribution for the class CL is shown at C1.

Each currency acceptor 4 is operable to measure the characteristic and determine whether the measurement meets a measurement criterion. In this example, the criterion is met if the measurement lies within the range R shown in FIG. 3. If so, then the measurement is considered suitable for an article of the class CL, and similar tests are performed for the other measurements.

It is however possible that some articles received by the currency validator have a distribution shown at C2, and belong to a different class CL'. These articles may be a new type of counterfeit which was not taken into account when specifying the range R used by the currency acceptors to test whether articles belong to class CL. Alternatively, there may be a new type of genuine currency article, physically similar to class CL articles and of the same denomination, which has slightly different characteristics from the ones used for establishing the measurement criteria including the range R (for example, the same monetary item, but produced by a different mint).

It will be noted that some of the articles belonging to class CL' may be accepted, because their measurements will fall within the range R, whereas others will not be accepted because their measurements lie outside the range R.

If articles of the class CL' are received, then the overall distribution of received articles for individual currency acceptors may no longer be similar to the distribution C1 shown in FIG. 3, but may instead have the shape shown at C3. In order to detect this situation, as explained below, the analysis program is arranged to detect the proportion of articles which are rejected because they have a measurement which falls below the range R. If this proportion corresponds to the shaded area A1 of FIG. 3, this suggests that the distribution of articles received by the currency validator does not differ significantly from what would be expected according to distribution C1. However, if the proportion corresponds to a combination of shaded areas A1 and A2, this suggests that a different class of articles is being received, thus distorting the distribution to correspond to C3.

Figure 2B:
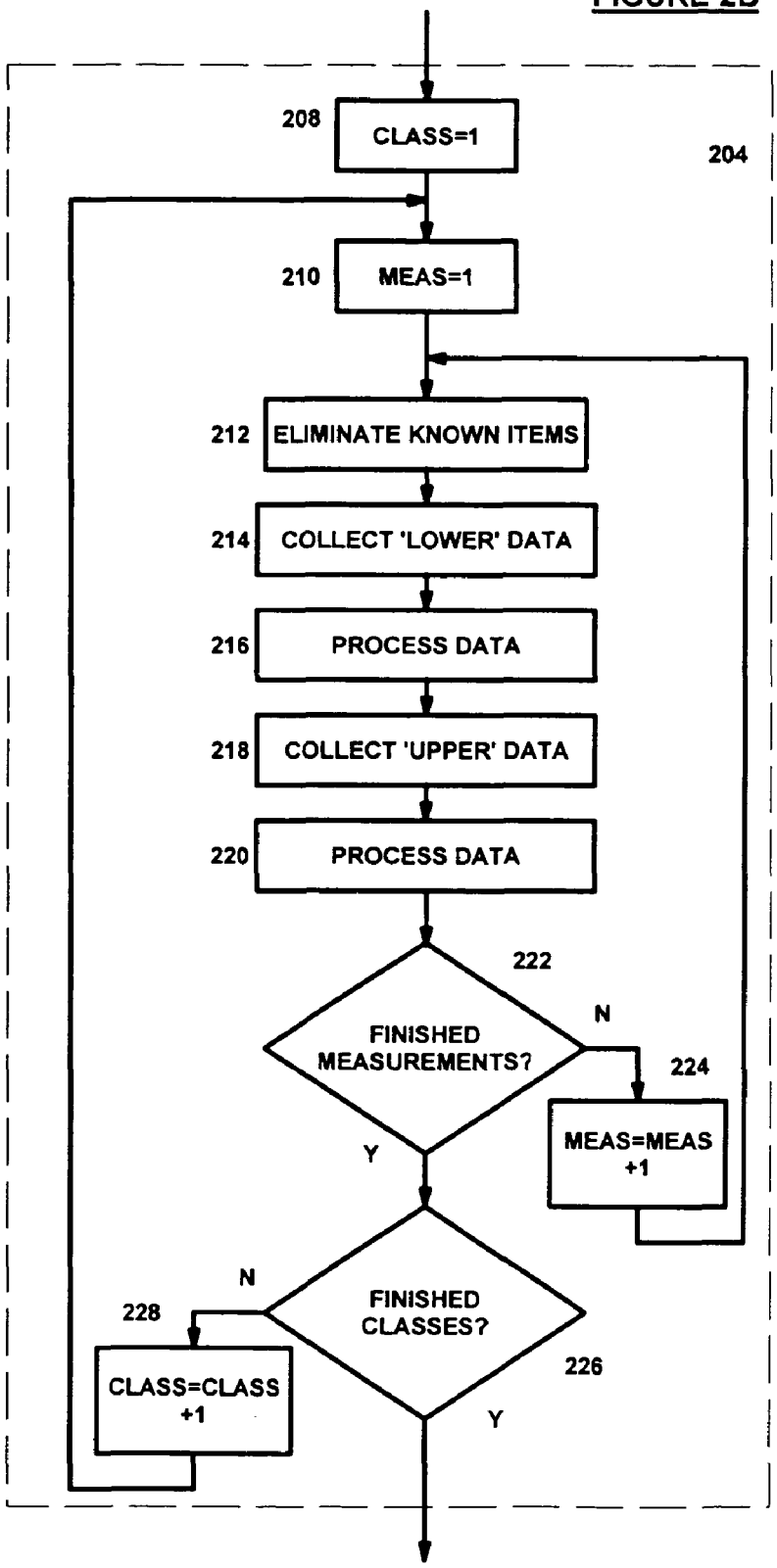

Referring to FIG. 2B, at step 208, a pointer CLASS is set to indicate a first of the target classes which the currency acceptors 4 are intended to accept. At step 210 a second pointer MEAS is set to indicate a first type of measurement made of each currency article.

At step 212, the measurements of type MEAS are gathered for all non-classified articles which have been tested and found to resemble (so far as this measurement MEAS is concerned) articles of class CLASS. For this purpose, for each measurement type there is set a wide range (indicated at W in FIG. 3) and all measurements falling within this range are collected. The analysis program then removes all measurements relating to known items, i.e. items which have been classified as belonging to class CLASS, or to any other target class. (It is to be noted that articles of other target classes may have some individual properties similar to articles of class CLASS, even though other properties may differ.)

Preferably the step 212 will also remove measurements relating to articles which are significantly dissimilar to all the target classes. That is, there will be taken into account only articles whose other measurements resemble the target class CL, and which therefore can potentially cause problems.

Any remaining measurements are likely to relate to (i) genuine articles with extreme values of the characteristic being measured, or (ii) counterfeits which have properties of unknown distribution (assumed to be random), or (iii) articles belonging to an identifiable further class such as CL'.

At step 214, the measurements which fall below the range R are gathered together. Then, at step 216, these measurements are processed in order to detect statistical anomalies as will be described below.

At step 218, the measurements which lie above the range R are gathered, and then at step 220 these measurements are also analysed to detect anomalies.

At step 222, the program detects whether all the measurements have been processed. If not, the pointer MEAS is incremented at step 224, and then steps 212, 214, 216, 218 and 220 are repeated.

After all the measurements have been processed in this way, the program proceeds to step 226 to detect whether all target classes have been processed. If not, the program proceeds to step 228 where the pointer CLASS is incremented, and the entire analysis procedure is repeated for the next class. After all the classes have been processed, the step 204 ends.

Figure 2C:
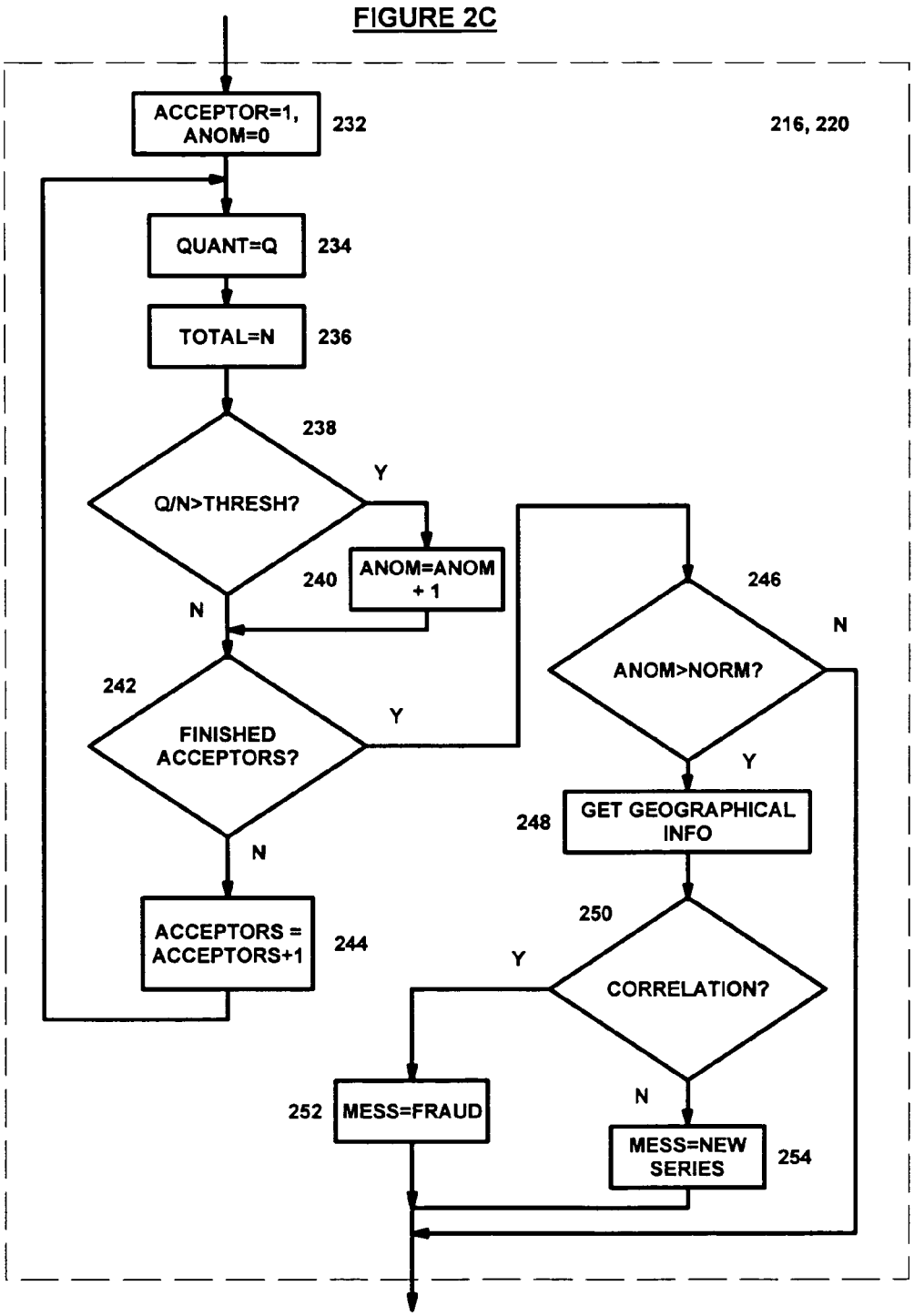

FIG. 2C shows the analysis procedures performed at steps 216 and 220, which are identical, and which use the data for non-classified articles derived at step 212.

In order to perform this procedure, the data for each currency acceptor 4 are checked in turn. Accordingly, at step 232, a pointer ACCEPTOR is set equal to one, indicating a first of the acceptors to be considered. Also, an anomaly counter ANOM is set equal to zero.

At step 234, the analysis program sets a variable Q equal to the number of measurements made by the current acceptor (these being measurements which fall within range W but outside the range R).

At step 236, a normalisation factor is determined. It will be appreciated that the total number of measurements falling outside the range R will depend to some extent on how often the acceptor 4 has been used. The normalisation factor is intended to compensate for this. The factor can be calculated in several different ways. In this embodiment, the total number of measurements which fall within the region W of FIG. 3 is determined for the current acceptor, including measurements of classified articles. A variable N is set equal to this value.

At step 238, the program determines whether the ratio Q/N is greater than a predetermined threshold, which was calculated during the statistical analysis step 203.

If the ratio Q/N is high, then this indicates that the distribution of received articles is unlikely to comply with the expected distribution C1 shown in FIG. 3, and accordingly the program proceeds to increment the anomaly counter ANOM at step 240.

At step 242, the program checks to determine whether the data for all the acceptors has been processed. If not, the pointer ACCEPTOR is incremented at step 244, and steps 234, 236, 238 and (if appropriate) 240 are repeated for the next acceptor.

After the data for all the acceptors has been checked, the program proceeds from step 242 to step 246. Here, the number of anomalies ANOM is compared to a normal value NORM (which may be established at step 203 and which is preferably related to the total number of acceptors 4 in the group being analysed, for example 5% of the total number). If ANOM≦NORM, then it is determined that no further action needs to be taken and the process 216, 220 finishes. However, if ANOM>NORM, i.e. there is a statistically significant number of anomalies, the program proceeds to step 248 to retrieve the geographical information (from store 16) for the acceptors which were found to have anomalous data.

At step 250, the program checks whether these acceptors are predominantly in close geographical relationship. If so, this is an indication that a new type of counterfeit is being used in that region and the program proceeds to step 252. This is likely to be reached if a new counterfeit has been developed, because these are often introduced in localised areas. At step 252, the program stores data to provide a message at step 206 indicating that there is a fraudulent type of anomaly, and will also store the identification numbers of the acceptors 4 for which this anomaly has been discovered. The program may also indicate the relevant class CLASS and measurement MEAS.

If no geographical correlation is found at step 250, the program proceeds to step 254. This is reached if the anomalies are geographically widespread. In this case, it is assumed that the problem arises because there is a new series of banknote which resembles banknotes of class CLASS but has on average a mean value of the measurement MEAS which is lower (or higher, in the case of process 220) than the mean for the class CLASS. There is therefore stored data indicating an anomaly of the type "new series", together with the identification numbers of the acceptors for which the anomaly has been discovered, and an indication of the values CLASS and MEAS.

The process 216 or 220 then finishes.

Figure 2D:
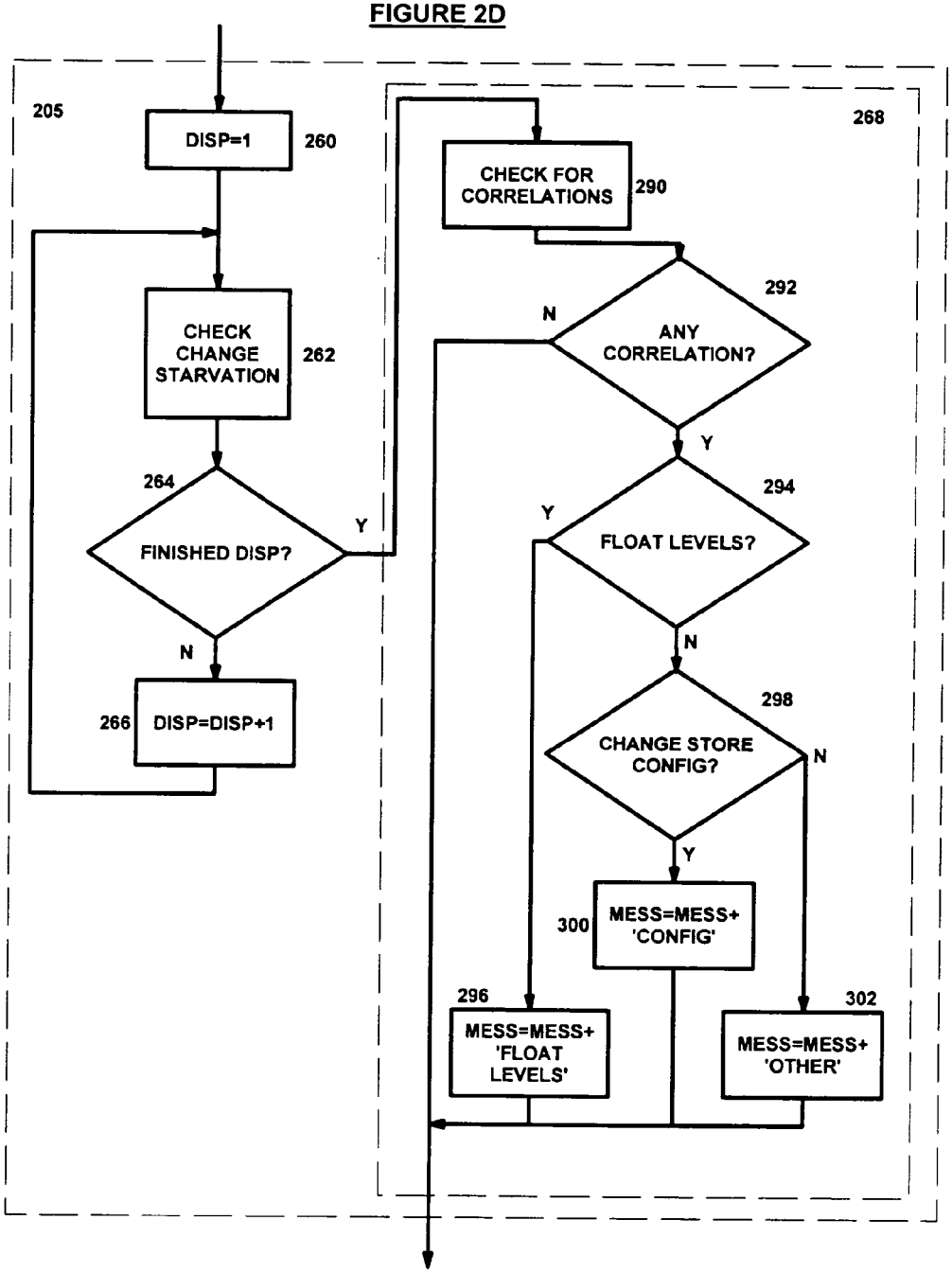

After the classification anomaly detection stage 204, the program proceeds to step 205 to determine whether there are any change-related anomalies. This procedure is illustrated in FIG. 2D.

At step 260, the program sets a pointer DISP to indicate a first of the denominations which can be dispensed as change by the currency acceptors 4.

The program then proceeds to step 262, in which it is determined (as described below) whether there is a significant anomaly amongst a number of currency acceptors which indicates that problems have arisen in the dispensing of change of denomination DISP.

The program then proceeds to step 264 to determine whether any more dispensable denominations should be checked. If so, the program increments the pointer DISP at step 266, and then repeats step 262 for the next change denomination.

This continues until all the dispensable denominations have been checked, following which the program proceeds from step 264 to step 268. At step 268, the program determines what kind of anomalies have arisen, and whether the problems can be resolved by changing float levels and/or reconfiguring the change stores of the acceptors where problems have arisen so that a different combination of denominations can be dispensed.

Figure 2E:
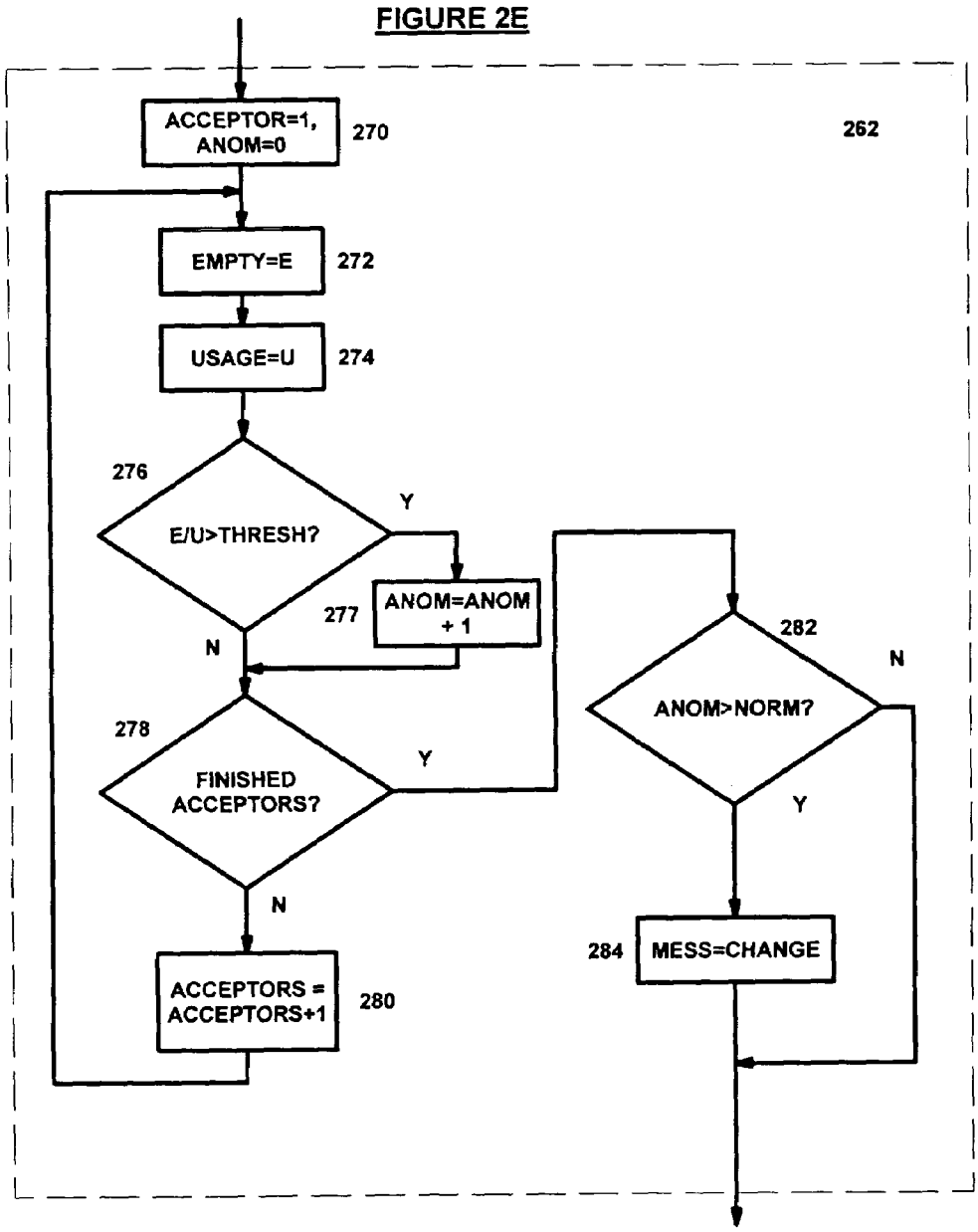

The analysis step 262 is shown in more detail in FIG. 2E.

At step 270, the pointer ACCEPTOR is set equal to one, indicating the first acceptor in the group. The anomaly counter ANOM is reset to zero.

At step 272, the program determines how many times the store containing denomination DISP in acceptor ACCEPTOR has become exhausted, thus rendering it incapable of providing change. A variable E is set equal to this number.

At step 274, a normalisation factor is determined. It will be appreciated that if a currency acceptor is used very frequently, then it is more likely to become depleted of change. Accordingly, to enable comparisons between different acceptors, a usage factor U is calculated. This can be based on any of a number of different parameters, such as the number of transactions performed by the acceptor, the number of articles of denomination DISP which have been received, the time since the last float operation, etc.

At step 276, the program checks to determine whether the ratio E/U extends a threshold, which threshold could be calculated at the preliminary analysis step 203.

If the threshold is exceeded, this indicates that the acceptor had a change-dispensing problem more frequently than would be expected, and the program proceeds to step 277 to increment the anomaly counter ANOM.

At step 278, the program checks whether this procedure has been carried out in respect of all acceptors. If not, the program proceeds to step 280 to increment the pointer ACCEPTOR, and then repeats steps 272, 274, 276 and, if appropriate, 277 for the next acceptor 4.

This continues until the data for all the acceptors has been checked, following which the program proceeds from step 278 to step 282 to check whether the anomaly counter ANOM exceeds a threshold level indicating an abnormality. This threshold level is preferably based on the number of currency acceptors 4 in the group being analysed, and therefore a problem is established if the number of machines exhibiting anomalies exceeds a certain percentage.

In this case, the program proceeds to step 284, at which there is stored data for a message indicating anomalous behaviour in respect of the dispensing of change of denomination DISP, together with the identification numbers of the relevant acceptors exhibiting the anomaly.

This finishes the change data analysis step 262.

Returning to FIG. 2D, it will therefore be appreciated that when step 268 is reached, there is stored a list of denominations for which a statistically significant number of acceptors have had dispensing problems, and for each denomination a list of the identities of the currency acceptors showing these problems. For each of the acceptors, the program can determine (a) the denominations which are stored in the change stores 10, (b) the float levels for the change stores, and (c) the prices of services or goods provided by the host equipment containing the currency acceptor. This data can be contained in the performance data transmitted by the currency acceptors 4, or could instead be stored in the store 16.

At step 290, the data is analysed to locate correlations between the configurations defined by this data and any change dispensing problems located at step 262.

At step 292, the program determines whether any correlation has been found. If not, the change anomaly detection step 205 finishes. Otherwise, the program proceeds to step 294 to determine whether there is a correlation between float levels and change problems, which could occur if the float levels are too low. If so, the program proceeds to step 296, where it calculates, for each of the currency acceptors 4 having change dispensing problems, new float levels. These new float levels may be based on the average of float levels in currency acceptors 4 which do not have change-starvation problems. This data is then appended to the data which was stored at step 284 so that it will be subsequently displayed during the display procedure 206.

If no such correlation has been found, the program proceeds from step 294 to step 298 to determine whether there is any correlation between change-starvation and the configuration of the change stores 10. If so, the program proceeds to step 300, in which the program determines, for each of the acceptors 4 which have change-starvation problems, a recommended new configuration. This could be the most prevalent configuration used in other currency acceptors 4 which do not have change-starvation problems and which have similar stored prices.

Again, this information is appended to the information stored at step 284.

If the step 298 finds no correlation with the change-configuration data, then the program proceeds to step 302. Here, other information could be appended to the data stored at step 284 depending upon the nature of the correlation which has been observed.

It will be appreciated from the description set out above that when the analysis is completed and the program reaches step 206 (FIG. 2A) the information stored at steps 252, 254, 284, 296, 300 and 302 can be displayed to permit remedial action to be taken.

At step 206, the program preferably also performs the following operations:

(a) develops and displays additional information and a series of recommendations for dealing with any located anomalies. For example, if a class of articles CL' has been discovered, values representing the class (such as the mean and standard deviation) are calculated and displayed. If the class CL' is determined probably to be a class of counterfeits, a recommendation may involve raising the lower limit of the range R (FIG. 3). Alternatively, the recommendation may be to calculate measurement criteria for the class CL' so that this can be added to the target classes recognised by the acceptors 4 and/or arranging for any further notes of this class to be retained in a trash bin of the acceptor for collection and inspection. Other recommendations may include changes of float levels or re-configurations of change stores;

(b) storage of new statistical data received from the acceptors, so that this can be used at step 202 in subsequent operations; and (c) determination of whether any existing measurement criteria (including criteria stored by acceptors which do not exhibit anomalous behaviour) should be altered, and display of appropriate recommendations. This is advantageous, because the use of measurement data from existing acceptors 4 in the field considerably increases the amount of statistical data available for use in developing measurement criteria compared with known systems in which the statistical data is produced in the manufacturer's factory. This operation is preferably performed only if performance data is obtained from all, or many, acceptors, rather than merely acceptors exhibiting anomalous behaviour.

In a preferred embodiment of the invention, the program has additional steps as shown in broken lines in FIG. 2A. In this embodiment, the program proceeds from step 206 to step 320, at which a system supervisor has the ability to indicate whether or not any of the displayed recommendations should be implemented.

Then, at step 322, the system will carry out automatically those recommendations which the supervisor has indicated should be implemented. This could involve sending to some or all of the acceptors 4 (a) modified measurement criteria, (b) a signal for enabling a new target class CL' to be recognised (possibly accompanied by measurement criteria for the class CL', and preferably in a system in which each acceptor can modify its measurement criteria for a target class in response to measurements of articles belonging to that class, as described in GB-A-2 059 129), (c) instructions for the acceptor to retain in a separate store (e.g. a trash bin) any further articles of the new class CL', and/or (d) float levels or re-configuration data which can be shown to a serviceman on an internal display of the acceptor 4 during a float operation, etc.

Many modifications of this embodiment are possible.

In the above-described arrangement, the acceptors 4 can individually detect potential performance problems, and the performance data for multiple acceptors is then analysed to detect specific anomalies. The second step could if desired be omitted, and instead the central analysis could be arranged simply to detect the total number or proportion of acceptors reporting similar problems, this therefore being an indication of external influences. This would reduce the amount of performance data which has to be collected by the server 6. For example, it would not be necessary to transmit measurement data to the server 6. Alternatively, the first step could be omitted, so that data is collected from all acceptors and anomaly detection is confined to the central analysis.

In ether case, the individual acceptors and/or the central analysis software is preferably arranged to detect when multiple articles are rejected for the same reason, for example, in the case of banknotes, as a result of the parameters of a particular area of the banknote and/or the optical characteristics in a particular wavelength, etc.

Although the acceptors 4 have been described above as using a windows-based technique for classification, the invention is applicable to other classification techniques, including multivariate techniques. For example, multiple measurements of an article may be combined to derive a Mahalanobis distance representing the degree of similarity of the article to the mean of a target class. See for example EP-A-0560023. Anomalies may be detected by determining the number of articles which have a Mahalanobis distance lying within a predetermined range and, preferably, which have measurements of certain properties individually or collectively falling within particular ranges.

The central analysis program described above is intended to detect classification anomalies, and the acceptors send measurement data relating at least to some of the rejected articles, and possibly also measurement data relating to accepted articles. However, the invention extends to systems arranged to collect measurement data in order to enhance classification performance, as indicated above, without performing the function of anomaly-detection. Thus, the system can be arranged to collect from the acceptors 4, at regular intervals, measurement data relating to accepted articles and, preferably, rejected articles, and to add this to a central database. This database can then be used to produce enhanced measurement criteria which can be transmitted to the acceptors 4 in order to improve their classification performance.

It is known to provide acceptors with a self-adaptation technique, whereby measurements of articles are used to update the measurement criteria. The present invention provides an enhancement of (or possibly an alternative to) this technique, whereby the measurement criteria are updated in response to a statistical analysis of data from multiple acceptors instead of, or in addition to, alterations on the basis of measurements made within the same acceptor.

In one particular example, the acceptors 4 store, for each target class, measurement criteria for use in multivariate classification. For example, the stored data define an inverse co-variance matrix, which is used to calculate a Mahalanobis distance for each received article indicative of the likelihood that the article belongs to the respective target class. Preferably, the stored data includes first data and second data. The first data is altered using self-adaptation techniques in response to measurements of classified articles, as described in GB-A-2 059 129. This can therefore compensate for changes in the characteristics of the mechanism due for example to wear or temperature drift which cause changes in the sensor response characteristics. The second data may be representative of the statistical distribution of measurements of articles belonging to the target class. This can be modified in response to information received from a central server, thus avoiding problems which might arise if the second data were to be updated by only measurements made by the acceptor itself, which may be statistically unrepresentative.

This arrangement has the advantage that the measurement criteria can be adapted to the individual characteristics of the acceptor 4, using the first data, while nevertheless being updated by the central server based on statistical information from the entire group of acceptors 4. However, this advantage can also be achieved in other ways. For example, the centrally-derived measurement criteria could be adapted for each individual acceptor 4 before being transmitted to the acceptor. For example, information relating to the individual characteristics of the acceptor could be stored (e.g. in identification store 16) and used for adapting the measurement criteria.

The acceptors 4 within the transaction system 2 may belong to a common customer who operates the central analysis program. Alternatively, the acceptors may belong to a more widespread group, and the central analysis system may be operated by the acceptor manufacturer.

Although a separate central server is used in the above embodiment to perform the data analysis, this is not essential. The processing could be carried out by one of the acceptors, or, if distributed processing is used, by a plurality of the acceptors.

The statistical data analysis could be used for purposes other than those set out above. For example, analysis of data indicative of a widespread type of fault, such as a coin jam, together with a correlation with the type of coin causing the jam, could be indicative of a manufacturing problem resulting in coin burrs. Widespread failure of a particular banknote denomination to pass a fitness test (see, for example, EP-A-0 706 698) could indicate a problem in the printing of the banknotes.

What is claimed is:

1. A method of monitoring the operation of a group of currency acceptors in a transaction system in which performance data from the acceptors is analyzed to determine whether an aspect of the performance of a plurality of acceptors differs in a similar way from an expected distribution, thereby indicating that external influences are likely to have caused that performance difference.

2. A method as claimed in claim 1, including using past performance data from the acceptors to determine whether the performance of said plurality of acceptors has altered in said similar way.

3. A method as claimed in claim 1, including determining whether the performance data from said plurality of acceptors indicates a statistically significant difference in performance as compared with other acceptors.

4. A method as claimed in claim 1, wherein the performance data for the group of acceptors is transferred for analysis to a server.

5. A method as claimed in claim 1, wherein each currency acceptor is arranged to transmit performance data for analysis in response to detection of one of a plurality of predetermined conditions, and in which said determining step is performed in dependence upon the number of currency acceptors transmitting performance data representative of a similar predetermined condition.

6. A method as claimed in claim 1, wherein the performance data includes at least first performance data and second performance data, means being provided to request the second performance data from a currency acceptor in dependence upon the content of the first performance data for that currency acceptor.

7. A method as claimed in claim 1, wherein the performance data includes data dependent upon measurements made of currency articles.

8. A method as claimed in claim 7, wherein the performance data includes data dependent upon measurements made of rejected currency articles.

9. A method as claimed in claim 8, wherein the performance data indicates which of a plurality of measurements caused rejection of the article.

10. A method as claimed in claim 9, wherein the performance data distinguishes between those measurements which are responsible for rejection because they are found to be too low and those which are found to be too high.

11. A method as claimed in claim 7, wherein each currency acceptor is arranged to recognise articles belonging to a predetermined set of classes, the method including the step of analysing the performance data in order to determine whether this indicates that a plurality of currency acceptors have been receiving articles belonging to a further class which differs from any of the predetermined set.

12. A method as claimed in claim 11, including analysing the performance data in order to derive, at least, data representing the means of the measurements of articles of said further class.

13. A method as claimed in claim 11, including the step of sending to at least one currency acceptor an instruction which causes the currency acceptor to begin to recognise currency articles of said further class.

14. A method as claimed in claim 13, including the step of transferring measurement criteria to said currency acceptor for use in evaluating measurements of currency articles to determine whether they belong to said further class.

15. A method as claimed in claim 1, wherein the determining step takes into account data representing the geographical distribution of the currency acceptors.

16. A method as claimed in claim 1, wherein each currency acceptor is operable to dispense stored currency articles of respective different denominations, the performance data including data dependent upon changes in the levels of respective denominations stored for dispensing.

17. A method as claimed in claim 16, wherein the performance data is dependent upon the number of times the quantity of a stored denomination has become inadequate to allow dispensing.

18. A method as claimed in claim 16, wherein each currency acceptor has re-configurable storage facilities so as to permit changing of the maximum number of currency articles of different denominations which can be stored, the method including the step of analysing the performance data from the respective currency acceptors to determine how at least a plurality of the currency acceptors should be re-configured in order to reduce the likelihood of a stored denomination becoming depleted.

19. A method as claimed in claim 16, wherein the performance data comprises indications of the quantities of stored currency articles of respective different denominations prior to a change-replenishing operation on a currency acceptor which leaves the quantities of stored currency articles at respective float levels.

20. A method as claimed in claim 19, including the step of determining, for at least a plurality of currency acceptors, an adjusted float level for a stored denomination.

21. A method as claimed in claim 1, including the step of generating measurement criteria for use by the currency acceptors to recognise articles, the measurement criteria being generated by analysing article measurements contained in said performance data.

22. A method as claimed in claim 21, including the step of transmitting the measurement criteria to the currency acceptors.

23. A transaction system comprising a plurality of acceptors and means for performing a monitoring operation as claimed in claim 1.

24. A method of operating a transaction system which comprises a plurality of currency acceptors, the method comprising installing the acceptors in host machines, performing individual transactions using the machines, collecting performance data from the acceptors, performing a statistical analysis on the performance data from the acceptors, deriving re-configuration data for at least one acceptor as a result of the statistical analysis and re-configuring said at least one acceptor on the basis of the re-configuration data.

25. A method as claimed in claim 24, wherein the performance data includes data dependent upon measurements made of currency articles.

26. A method as claimed in claim 25, wherein the re-configuration data includes measurement criteria used by the acceptor for classifying currency articles.

* * * * *